United States Patent [19]

Durr et al.

[11] Patent Number: 4,963,043

[45] Date of Patent: Oct. 16, 1990

[54] PRINTER

[75] Inventors: Heinrich Durr, Wilnsdorf; Manfred Adamek, Kirchen-Freusburg, both of Fed. Rep. of Germany

[73] Assignee: U.S. Philips Corporation, New York, N.Y.

[21] Appl. No.: 345,390

[22] Filed: May 1, 1989

[30] Foreign Application Priority Data

May 3, 1988 [DE] Fed. Rep. of Germany ..... 3814926

[51] Int. Cl.[5] ..... B41J 32/00; B41J 35/22

[52] U.S. Cl. ..... 400/196; 400/194; 400/207; 400/208; 400/224; 400/240.4

[58] Field of Search ..... 400/194, 195, 196, 196.1, 400/207, 208, 208.1, 212, 216.1, 216.3, 224, 240, 240.4, 247, 248, 248.1, 248.2, 248.3

[56] References Cited

U.S. PATENT DOCUMENTS

| | | | |
|---|---|---|---|
| 4,011,934 | 3/1977 | Ploby et al. | 400/212 |
| 4,236,839 | 12/1980 | Mueller | 400/216.1 |
| 4,257,282 | 3/1981 | Wilczewski et al. | 400/224 X |
| 4,280,767 | 7/1981 | Heath | 400/196.1 X |
| 4,425,046 | 1/1984 | Van Horne et al. | 400/208 |
| 4,563,100 | 1/1986 | Hamamichi | 400/208 |
| 4,643,601 | 2/1987 | Nash et al. | 400/216.1 |
| 4,650,355 | 3/1987 | Cassiano et al. | 400/248 X |
| 4,801,215 | 1/1989 | Paffhausen et al. | 400/224 |
| 4,820,068 | 4/1989 | Mitcham | 400/216.1 |
| 4,875,789 | 10/1989 | Sato | 400/196.1 |

FOREIGN PATENT DOCUMENTS

| | | | |
|---|---|---|---|
| 0175010 | 3/1986 | European Pat. Off. | 400/208 |
| 3607937 | 9/1987 | Fed. Rep. of Germany | 400/216.1 |
| 0078685 | 4/1986 | Japan | 400/212 |
| 0205177 | 9/1986 | Japan | 400/212 |
| 0270184 | 11/1986 | Japan | 400/212 |

*Primary Examiner*—Edgar S. Burr
*Assistant Examiner*—C. A. Bennett
*Attorney, Agent, or Firm*—William Squire

[57] ABSTRACT

A pivotally journalled ink ribbon cassette and an ink ribbon fork are coupled to the carriage of a printing head and arranged so as to be displaceable transversely to the line direction, in a simple manner such that both a multi-color and a single-color mode of operation are obtained. The ink ribbon fork is arranged at its free end so as to be pivotable and longitudinally displaceable on a guide rod journalled in guide arms of the ink ribbon cassette, and in that with respect to the position of the printing roller and of the printing head both means for transverse displacement of the ink ribbon fork and means for oblique positioning of the ink ribbon cassette with ink ribbon are provided.

10 Claims, 3 Drawing Sheets

PRINTER

The invention relates to a printer, comprising a pivotally journalled ink ribbon cassette, which has guide arms for the ink ribbon which are bent and directed towards a print anvil, as well as an ink ribbon fork, which is coupled to a carriage of a print head displaceable in the line direction and is arranged so as to be displaceable transversely to the line direction.

Such a construction is known, for example, from German Patent Application No. 3607937 assigned to the assignee of the present invention. In the known construction, on the one hand the ink ribbon fork journalled on the carriage of the print head can be lifted by a lifting device, which engages at the area of the guide arms, while on the other hand a separate lifting drive is used, which is coupled to said lifting device and directly acts upon the ink ribbon fork. This separate lifting drive has a ram, which can be actuated by the lifting device through a pulling rope.

In the preamble of the description of the aforementioned German Patent Application, reference is further made to a construction in which the ink ribbon cassette is arranged in a specific pivotable frame. This frame forms part of the housing. In this construction, the ink ribbon fork is arranged on a guide rod so as to be displaceable in the line direction, which guide rod in turn forms part of the pivotable frame. The ink ribbon fork coupled to the print head slides linewise to and fro on this guide rod. This known construction requires a complicated accurate shaping of the pivotable frame in order to achieve that the guide rod in all pivot positions is arranged so as to be sufficiently accurately parallel to the line direction. Only by an accurate parallel guiding, the ink ribbon fork guided on the guide rod can hold the ink ribbon in every position of the print head at a constant level.

The invention has for its object to construct a printer of the kind mentioned in the opening paragraph in such a manner that in a simple manner both a reliable multicolour mode of operation and a reliable single-colour mode of operation can be obtained.

A printer according to the invention is characterized in that the ink ribbon fork is arranged so as to be pivotable and longitudinally displaceable on a guide rod journalled in the guide arms, and in that with respect to the position of the print anvil and of the print head means are provided for transverse displacement of the ink ribbon fork to align different ribbon tracks with a print head in a first multi-color print mode and means for oblique positioning of the ink ribbon to allow the print head to print diagonally across the width of the ribbon in a second mono-color print mode.

Due to the construction according to the invention, first it is achieved that the parts subjected to wear, such as, for example, the guide rod and the ink ribbon fork, are associated with the cassette, which can be exchanged in a simple manner. Therefore, in the case of a defect of these parts, it is no longer necessary to exchange a part of the basic apparatus. Further, the construction according to the invention permits in the first simple manner both a mode of operation with multicolour ink ribbons by parallel displacement, i.e. transverse movement, of the ink ribbon fork and a second mode of operation with mono-colour ink ribbons by oblique positioning of the ink ribbon cassette and hence of the ink ribbon, i.e. with the same construction of the ink ribbon cassettes. For the multi-colour mode of operation, a motor drive engaging the ink ribbon fork is provided on the carriage for transverse displacement of the ink ribbon fork, the guide rod with the ink ribbon fork being arranged so as to be pivotable about a rotation axis, which is located at the area of the ink ribbon cassette parallel to the print anvil.

In this construction, the ink ribbon fork and hence the ink ribbon is positioned immediately and directly, as a result of which a very accurate adjustment and guidance of the ink ribbon is obtained. The cassette is supported via the guide rod. Thus, a robust reliable construction is obtained with a high positioning accuracy of the multi-colour ribbons. Further, by the direct actuation of the motor drive, short position switching times are obtained.

For a mono-colour mode of operation, only a mono-colour ribbon is required. For this purpose, the ink ribbon cassette with the guide rod, the ink ribbon and the ink ribbon fork hinged thereto is positioned obliquely from the horizontal position in such a manner that the print head passes over the mono-colour ribbon over a line width approximately diagonally.

Thus, in the case of a mono-colour mode of operation, the overall width of the mono-colour ribbon can be fully utilized. The oblique positioning of the ink ribbon cassette is attained by projections which are formed in the lateral end regions, for example, by breaking out and cooperating with protrusions on the housing.

In the case of a multi-colour mode of operation with a motor drive on the carriage, the ink ribbon fork is preferably provided with a rack, which cooperates with the motor drive.

Since the ink ribbon cassette performs with the guide arms a rotary movement about the rotation axis, the ink ribbon fork is preferably secured to the guide rod through a slot connection.

If in a construction a motor drive is provided on the carriage of the print head, a mono-colour mode of operation can also be obtained in which the associated ink ribbon fork of the ink ribbon cassette does not include a rack so that no displacement of the ink ribbon fork by the drive can take place. Thus, the print head provided with a motor drive is suitable both for a mono-colour and for a multi-colour mode of operation.

In the drawing, FIGS. 1 to 5 show embodiments of the apparatus according to the invention.

Figure 1:
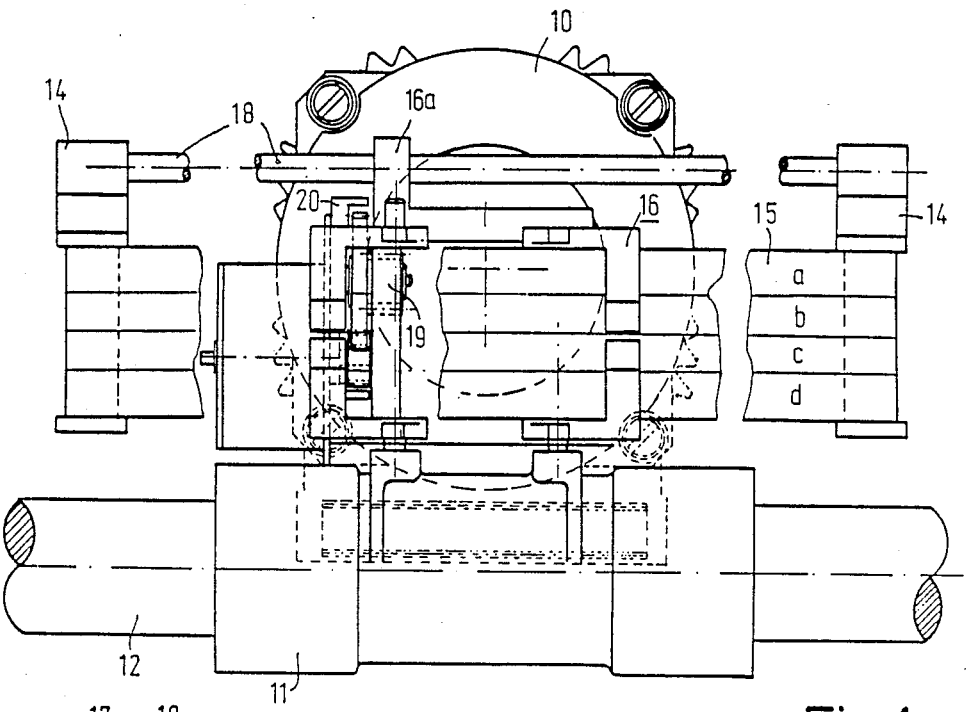
FIG. 1 is a partial elevation of a needle printer for a multi-colour mode of operation, viewed on the broad side of an ink ribbon cassette.

FIGS. 1 to 5 show in section a part of a needle printer with a print head 10 secured on a carriage 11. The carriage 11 with the print head 10 is displaceable to and fro on a shaft 12 in the longitudinal directions 25. Parallel to axis 26. Reference numeral 13 denotes an ink ribbon cassette (FIG. 2), which is provided with lateral guide arms 14 extending in the direction of a print anvil (not shown). A quadruple ink ribbon 15 with four ink tracks 15*a–d* extends between the guide arms 14 and is guided therebetween by an ink ribbon fork 16. The ink ribbon fork 16 is coupled to the carriage 11 and therefore moves to and fro with the carriage 11. The coupling is such that the ink ribbon fork 16 (cf. FIG. 4) can be positioned obliquely. The ink ribbon fork 16 is hinged at its free end with a guide part 16*a* through a slot connection 17 to a guide rod 18, which is in turn journalled in the lateral guide arms 14. Reference numeral 19 denotes a motor drive, which is arranged on the carriage 11. According to FIGS. 1 to 3, the ink ribbon fork 16 is provided with a rack 20, which engages the motor drive 19. The ink ribbon cassette 13 is rotatably journalled about a rotary axis 21 via journal bearing 21', for example in the housing of the needle printer. In the monocolour mode shown in FIGS. 4 and 5, the carriage 11 carries in the present embodiment also a motor drive 19, but in this case the ink ribbon fork 16 is not provided with a rack. Reference numeral 22 denotes in FIG. 4 a projection, which serves for the oblique positioning of the ink ribbon cassette 13 and bears on a protrusion 23, for example of the housing.

Figure 2:
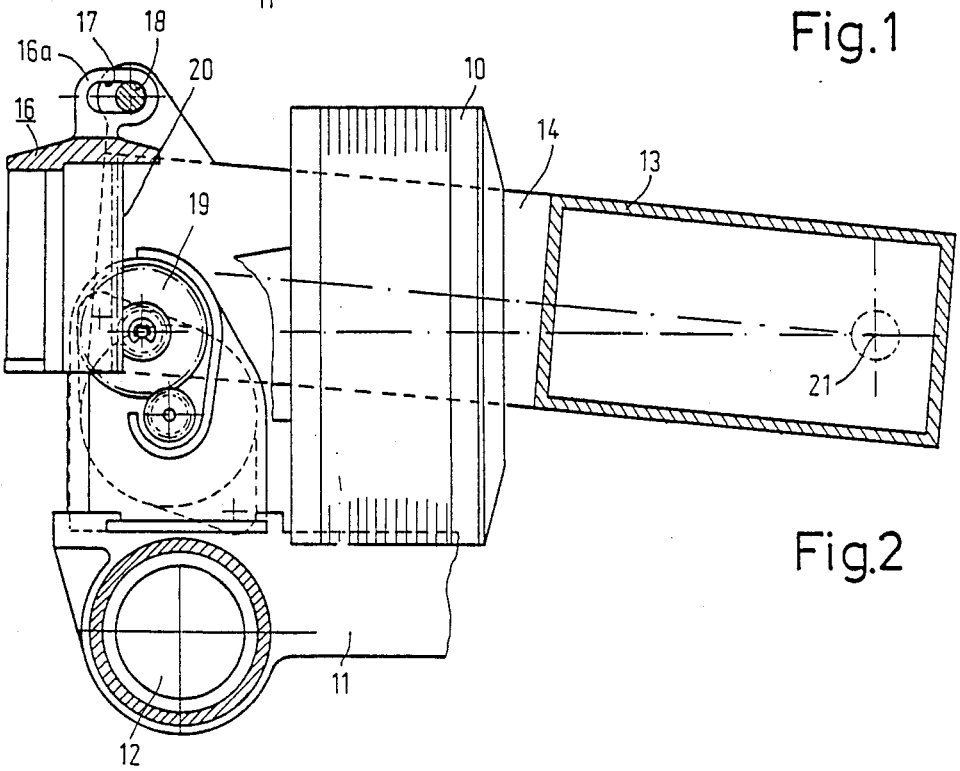
FIG. 2 is a sectional side elevation according to FIG. 1 in a first operating condition.
Figure 3:
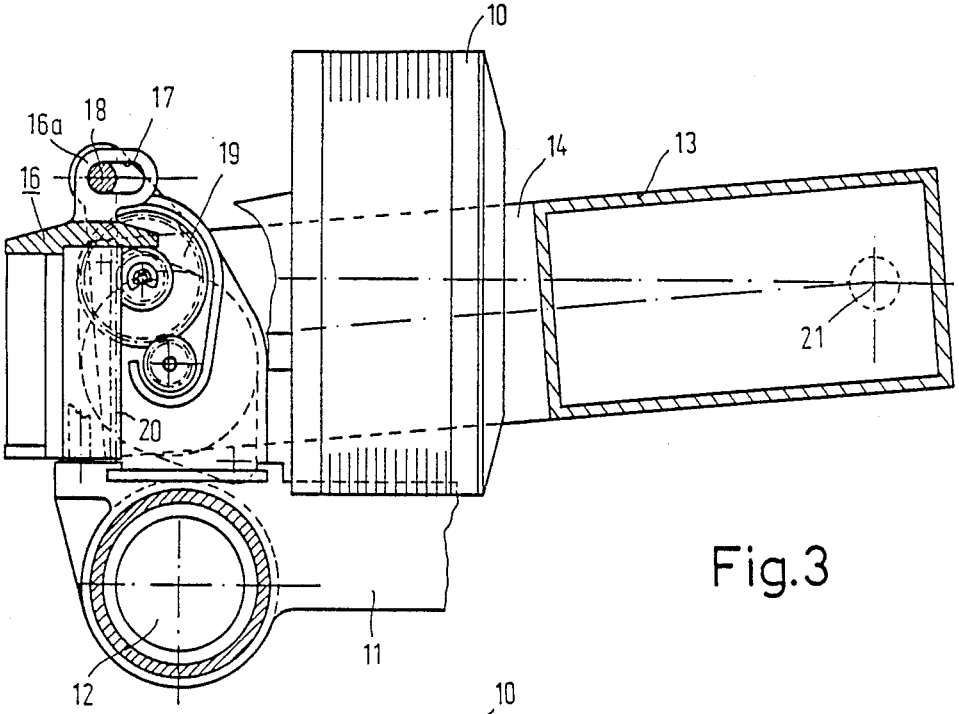
FIG. 3 is a sectional side elevation according to FIG. 1 in a second operating condition.

According to FIGS. 1 to 3, the parallel displacement of the ink ribbon cassette 13 takes place by actuation of the motor drive 19, a displacement transverse to the line direction taking place through the rack 20 in such a manner that the guide rod 18 always extends parallel to the shaft 12 and to the print anvil not shown, respectively. FIG. 2 shows the cassette 13 in an upper position, the lower part of the ink ribbon 15 being printed. According to FIG. 3, the ink ribbon cassette 13 is pivoted about the axis 21 into a lower position so that now the upper part of the ink ribbon 15 can be printed. This displaceability by means of the motor drive 19 permits a very accurate positioning of the ink ribbon 15 so that each of the ink tracks present on the ink ribbon 15 can be adjusted and maintained without any problems.

Figure 5:
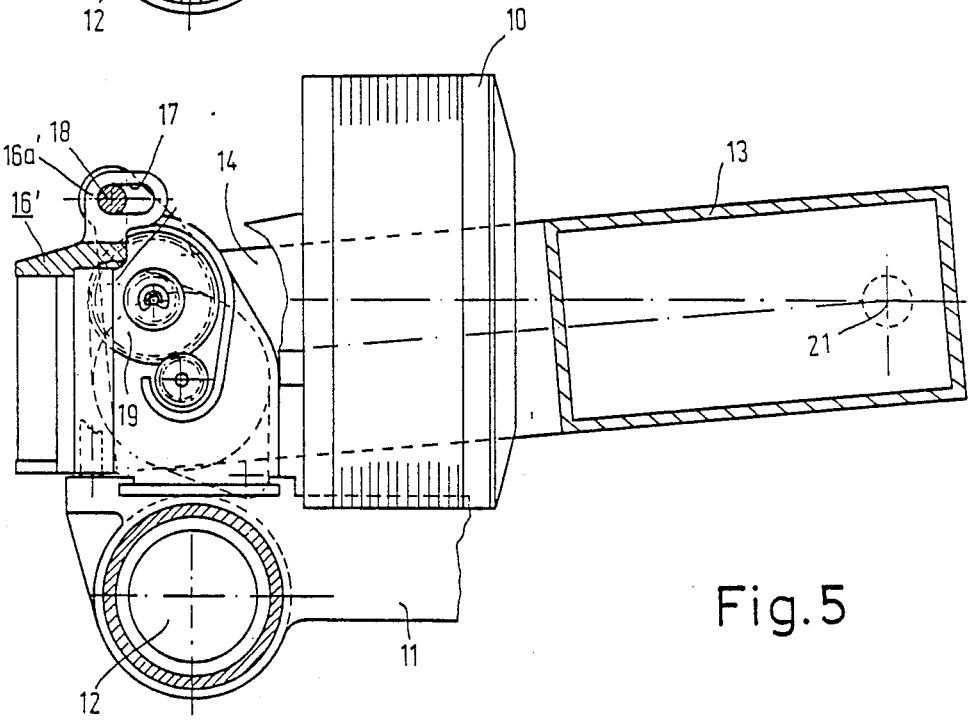
FIG. 5 is a sectional side elevation according to FIG. 4.
Figure 4:
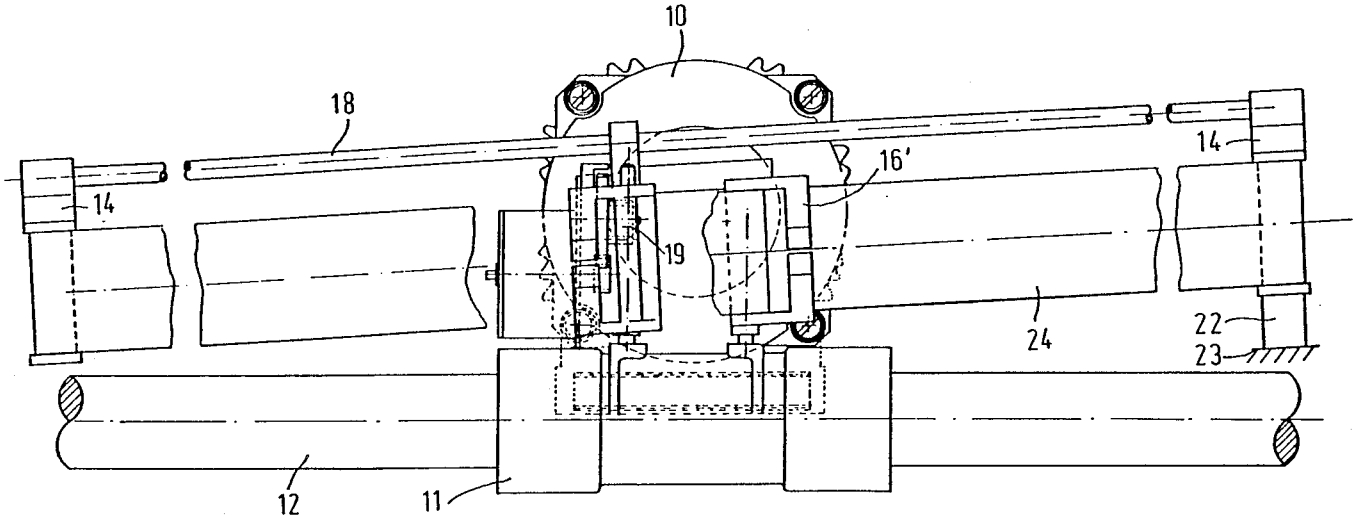
FIG. 4 is a front elevation of a needle printer for a mono-colour mode of operation.

According to FIGS. 4 and 5, the ink ribbon cassette 13 is not pivoted about the axis 21; the whole ink ribbon cassette 13 with the single ink ribbon 24, the guide arms 14, the guide rod 18 and the ink ribbon fork 16 are positioned in such a manner that the guide rod 18 is located obliquely with respect to the print anvil (not shown) and the shaft 12, respectively, the anvil and shaft 12 being parallel. Element 16*a'* corresponds to guide part 16*a*, FIG. 2. The oblique positioning is obtained by means of the projection 22, which bears on the protrusion 23. By the oblique positioning the print head 10 running parallel to the shaft 12 passes diagonally over the single ink ribbon 24 so that an optimum utilization of the inserted ink ribbon 24, which is automatically pulled through, is obtained. The motor drive 19, shown in FIGS. 4 and 5, in this case is not essential because the ink ribbon fork 16 does not include the rack 20 of the embodiments of FIGS. 1–3, the cassette 13 includes a projection 22, FIG. 4, which can be broken out from the cassette 13. Projection 27 fixes the cassette in the oblique position, if desired, by mating with protrusion 23. This arrangement accommodates mono-colored ribbons as compared to multi-colored ribbons employed in the embodiment of FIG. 1.

We claim:

1. In a printer comprising a housing and a print head carriage including a print head secured to the carriage for displacement in a given print direction, an ink ribbon cassette construction adapted to be releasably secured to the housing, said construction including and ink ribbon storage cassette, a pair of spaced guide arms secured to the cassette for guiding the ribbon supplied by the cassette, an ink ribbon fork for supporting the ribbon between said arms, said fork being secured to the carriage for displacement therewith in said given print direction, the improvement therewith comprising:

means for pivotally securing the cassette and the arms secured thereto to said housing for rotation about an axis in a first mode;

a guide rod secured to the arms spaced from the cassette and parallel to said axis;

means for pivotally and longitudinally displaceably securing the fork to the rod between the arms;

drive means secured to the carriage for transversely displacing the fork relative to said given direction and to said carriage in said first mode, said arms and cassette pivoting about said axis in response to said transverse displacing; and means secured to the cassette and adapted to be selectively positioned so as to mate with and abut the housing in a second mode to thereby fixedly position the cassette, rod and arms relative to said housing such that the ribbon fork guide rod is obliquely oriented relative to said given print direction in said second mode, said arms and rod being so obliquely oriented in said second mode to cause the ribbon guided thereby to traverse a path through said fork in a direction oblique to said given print direction.

2. A printer as claimed in claim 1 characterized in that said means for pivotally and longitudinally securing includes means for securing the ink ribbon fork via a slot in the fork to the guide rod.

3. A printer as claimed in claim 1, characterized in that means are included for securing the ink ribbon cassette, the guide rod, the ink ribbon and the ink ribbon fork so that the ribbon extends obliquely relative to said given direction in such a manner that the print head passes approximately diagonally relative to the ink ribbon a transverse distance corresponding to a line width produced by the print head traversing in said given direction during printing.

4. A printer as claimed in claim 3 characterized in that said means for securing includes a projection at the area of the guide arms cooperating with a receiving protrusion secured to the housing.

5. A printer as claimed in claim 4, characterized in that the projection includes a portion of the ink ribbon cassette.

6. A printer as claimed in claim 1, characterized in that said means for transversely displacing includes a motor drive on the carriage for engaging and displacing the ink ribbon fork, said axis being located at the area of the ink ribbon cassette parallel to said given print direction.

7. A printer as claimed in claim 6, characterized in that said means for transversely displacing includes a motor drive secured to the carriage and a rack secured to the fork and engaged with the drive.

8. A printer as claimed in claim 7, characterized in that said means for pivotally and longitudinally securing includes means for securing the ink ribbon fork via a slot in the fork to the guide rod.

9. A printer as claimed in claim 8, characterized in that said means for securing includes a projection at the area of the guide arms cooperating with a receiving protrusion secured to the housing.

10. A printer as claimed in claim 9, characterized in that the projection includes a portion of the ink ribbon cassette.

* * * * *